US009725843B2

(12) United States Patent
Yang

(10) Patent No.: US 9,725,843 B2
(45) Date of Patent: Aug. 8, 2017

(54) LAUNDRY TREATING APPARATUS

(71) Applicant: LG ELECTRONICS INC., Seoul (KR)

(72) Inventor: Jinho Yang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 132 days.

(21) Appl. No.: 14/691,679

(22) Filed: Apr. 21, 2015

(65) Prior Publication Data

US 2015/0315737 A1 Nov. 5, 2015

(30) Foreign Application Priority Data

Apr. 21, 2014 (KR) ..... 10-2014-0047649

(51) Int. Cl.

*F21V 33/00* (2006.01)
*D06F 39/00* (2006.01)
*F21V 3/04* (2006.01)

(52) U.S. Cl.

CPC ..... *D06F 39/005* (2013.01); *F21V 3/0472* (2013.01); *F21V 33/0044* (2013.01)

(58) Field of Classification Search

CPC ..... F21V 3/0472; D06F 39/005; H01H 2219/062; H01H 2219/0621; H01H 2219/0622; H01H 19/025

(Continued)

(56) References Cited

U.S. PATENT DOCUMENTS 5,913,414 A * 6/1999 Pollock ..... H01H 19/025 200/316
2007/0119484 A1* 5/2007 Kwon ..... D06F 39/005 134/58 R (Continued)

FOREIGN PATENT DOCUMENTS

CN 105040363 11/2015
DE 10 2006023959 A1 1/2007

(Continued)

OTHER PUBLICATIONS

European Search Report dated Aug. 20, 2015, for European Application No. 15164489.5. 6 pages.

(Continued)

*Primary Examiner* — Renee Chavez
*Assistant Examiner* — Gerald J Sufleta, II
(74) *Attorney, Agent, or Firm* — Fish & Richardson P.C.

(57) ABSTRACT

A laundry treating apparatus is disclosed. The laundry treating apparatus includes control panel body that defines an opening with a circular perimeter and a diameter. The laundry treating apparatus further includes at least one light source. The laundry treating apparatus further includes a rotary knob that is configured to manipulate a rotary switch and that has an outer circumferential surface that is spaced apart from the circular perimeter of the opening to define a clearance between the rotary knob and the control panel body. The laundry treating apparatus includes further a knob decorative member that is located between the rotary knob and the circular perimeter of the opening. The laundry treating apparatus further includes a window that includes a light transmission portion through which light emitted from the at least one light source passes.

16 Claims, 7 Drawing Sheets

(58) Field of Classification Search
USPC ..... 200/310–317; 362/100
See application file for complete search history.

(56) References Cited

U.S. PATENT DOCUMENTS

| | | | | |
|---|---|---|---|---|
| 2009/0059561 | A1 | 3/2009 | Jang | |
| 2013/0271950 | A1* | 10/2013 | Park | F21V 33/0044 362/23.07 |
| 2014/0056022 | A1* | 2/2014 | Camli | F24C 7/082 362/551 |
| 2015/0062866 | A1 | 3/2015 | Park | |

FOREIGN PATENT DOCUMENTS

| | | | |
|---|---|---|---|
| EP | 2 039 821 | A1 | 3/2009 |
| EP | 2 650 422 | A1 | 10/2013 |
| KR | 10-2006-0120944 | A | 11/2006 |
| KR | 10-2007-0066601 | | 6/2007 |

OTHER PUBLICATIONS

Office Action issued in Chinese Application No. 201510190894.X dated Aug. 26, 2016, 11 pages (with English translation).

* cited by examiner

LAUNDRY TREATING APPARATUS

CROSS-REFERENCE TO RELATED APPLICATION

This application claims the priority benefit of Korean Patent Application No. 10-2014-0047649, filed on Apr. 21, 2014 in the Korean intellectual Property Office, the disclosure of which is incorporated herein by reference.

FIELD

This application relates to a laundry treating apparatus, and more particularly to a laundry treating apparatus which is constructed to radiate light from a light source to an area around a rotary knob.

BACKGROUND

Laundry treating apparatuses generally refer to apparatuses which are constructed to apply mechanical action generated by electric power to clothing and bedclothes (hereinafter, referred to as "laundry") so as to remove contaminants from the laundry or to supply hot air to the laundry so as to dry the laundry.

The laundry treating apparatus may include a control panel which enables commands for operation of the laundry treating apparatus to be input and which displays various information regarding the laundry treating apparatus.

The control panel may be mounted on an upper portion of the laundry treating apparatus. A user may manipulate at least one manipulation unit provided at the control panel while viewing various information displayed on the control panel, and the laundry treating apparatus may be operated by manipulation through the manipulation unit.

The manipulation unit may be provided with a tap switch which is switched by a button, a rotary switch which is rotated by a rotary knob, and the like.

The control panel may be provided with a decorative member having a light transmission hole to improve a decorative appeal, and light emitted from a light source may pass through the light transmission hole.

SUMMARY

According to an innovative aspect of the subject matter described in this application, a laundry treating apparatus includes a control panel body that defines an opening with a circular perimeter and a diameter; at least one light source; a rotary knob that is configured to manipulate a rotary switch and that has an outer circumferential surface that is spaced apart from the circular perimeter of the opening to define a clearance between the rotary knob and the control panel body; a knob decorative member that is located between the rotary knob and the circular perimeter of the opening, the knob decorative member having a diameter that is smaller than the diameter of the opening; and a window that includes a light transmission portion through which light emitted from the at least one light source passes, the light transmission portion of the window surrounding the rotary knob and covering the clearance between the rotary knob and the control panel body.

The laundry treating apparatus may include one or more of the following optional features. The light transmission portion has an annular exposed surface that is exposed to an outside of the laundry treating apparatus. The annular exposed surface is continuous across the light transmission portion of the window. The clearance and the light transmission portion both have an annular shape. The light transmission portion has an inner circumferential surface that faces an outer circumferential surface of the knob decorative member, and an outer circumferential surface that faces the circular perimeter of the opening. The light transmission portion has an internal diameter that is larger than an external diameter of the knob decorative member, and an external diameter that is smaller than a diameter of the opening.

The window has a stepped portion that contacts the control panel body. A front of the stepped portion and a back of the stepped portion both contact the control panel body. The knob decorative member includes an inner cylinder having an inner circumferential surface that faces the outer circumferential surface of the rotary knob; an outer cylinder that has a larger diameter than a diameter of the inner cylinder and that has an outer circumferential surface facing an inner circumferential surface of the light transmission portion; and a front annular portion connected between the inner cylinder and the outer cylinder. The inner cylinder of the knob decorative member has an inner circumferential surface that partially faces an inner circumferential surface of the window. The knob decorative member and the control body have a same color.

The window includes a window body that protrudes from the light transmission portion; and a diffusion portion located at a rear surface of the window body, the diffusion portion including a first region that has a first light transmittance and a second region that has a second light transmittance that is greater than the first light transmittance, where the second region at least partially faces the light transmission portion. The diffusion portion comprises a diffusion sheet that is located at a rear surface of the window body and that is printed on or coats the diffusion portion. The first region of the diffusion portion is configured to block light from the at least one light source. The knob decorative member is coupled to the window. The light transmission portion of the window surrounding the rotary knob is located in the clearance between the rotary know and the control panel body.

It is an object of the subject matter described in this application to provide a laundry treating apparatus capable of creating a lighting pattern having a continuously connected elongate shape at an area between a rotary knob and a control panel body.

DETAILED DESCRIPTION

Figure 1:
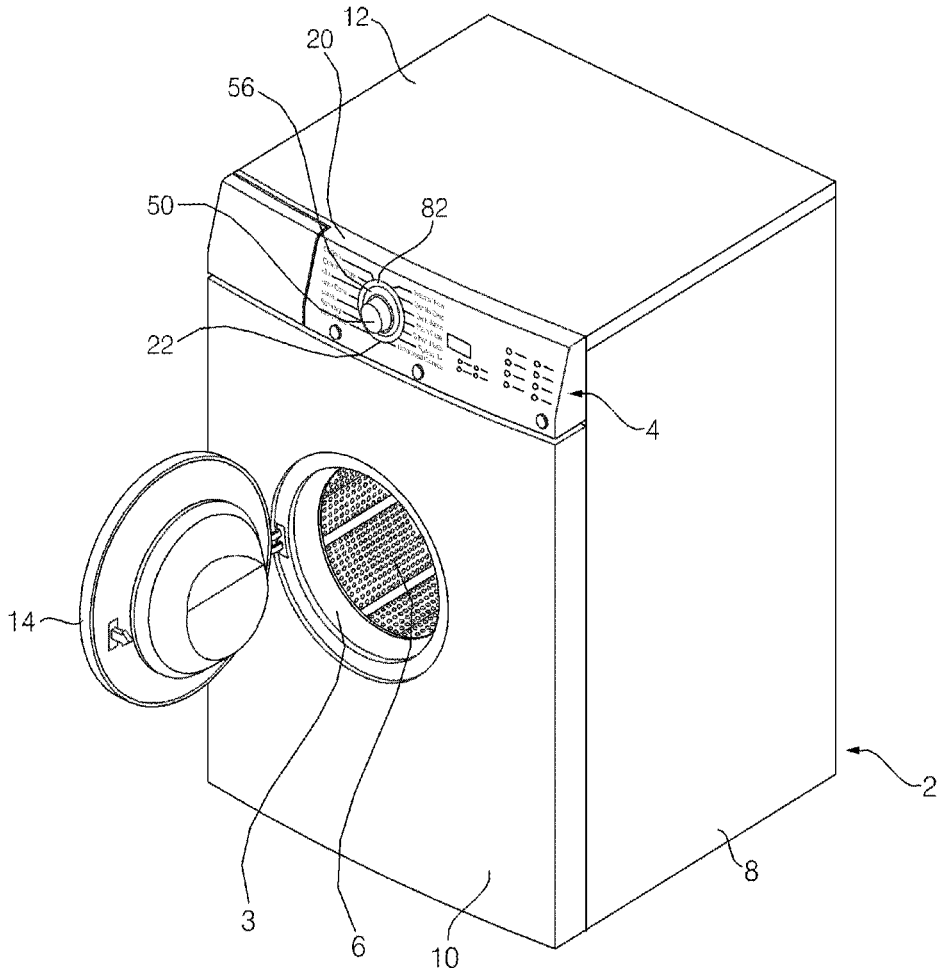
FIG. 1 is a perspective view of a laundry treating apparatus.

FIG. 1 illustrates an example laundry treating apparatus.

The laundry treating apparatus may include a cabinet 2, and a control panel 4 provided at the cabinet 2.

The cabinet 2 may be a case defining an external appearance of the laundry treating apparatus. The cabinet 2 may be provided with a laundry port 3 through which laundry is put into or taken out of the cabinet 2. The cabinet 2 may be provided therein with a tub for containing washing water. The tub may be provided therein with a drum 6 which is rotatable therein. The cabinet 2 may be provided therein with a motor for rotating the drum 6. If the laundry treating apparatus is a dryer, the tub for containing washing water may not be provided in the cabinet 2, and the drum 6 may be rotatably supported by a support installed in the cabinet 2.

The cabinet 2 may be constructed by bending a single member several times or by coupling a plurality of members to one another. The cabinet 2 may include a base pan, a cabinet body 8 installed on the base pan and having a space for accommodating the tub, a cabinet cover 10 disposed in front of the cabinet body 8 and including the laundry port 3, and a top cover 12 disposed on the cabinet body 8. The cabinet body 8 may be constructed by a single member, and may also be constructed by a plurality of members. The cabinet body 8 may include a left cover disposed on the left side of the base pan, a right cover disposed on the right side of the base pan, and a rear cover disposed on the rear side of the base pan. The cabinet 2 may be constructed by one of various combinations of a plurality of members and may be configured into various modifications.

The cabinet 2 may be provided with a door 14 for opening or closing the laundry port 3. The door 14 may be swingably connected to the cabinet 2 to open or close the laundry port 3, and may also be slidably coupled to the cabinet 2 to open or close the laundry port 3. The door 14 may be hinged to the cabinet 2 by means of a hinge element, and thus may be swung about the hinge element to open or close the laundry port 3.

The control panel 4 may include a manipulation unit. The control panel 4 may include a display unit for displaying information of the laundry treating apparatus. The control panel 4 may include both the manipulation unit and the display unit. The control panel 4 may be disposed on the cabinet cover 10. The control panel 4 may be disposed on a front surface of the cabinet 2, and may define a portion of the external appearance of the laundry treating apparatus.

The control panel 4 may include a control panel body 20. The control panel body 20 may define an external appearance of the control panel 4. The control panel body 20 may be disposed on the cabinet cover 10. The control panel body 20 may be provided with the manipulation unit for enabling user manipulation and the display unit for displaying various information of the laundry treating apparatus.

The control panel 4 may include a rotary knob 50 adapted to be gripped by user's fingers to allow user manipulation. The rotary knob 50 may be provided so as to select one of various treatment courses of the laundry treating apparatus. Therefore, a user may select one of the various treatment courses by gripping and rotating the rotary knob 50. The control panel body 20 may be formed with an opening 22 having a larger diameter than that of the rotary knob 50. The rotary knob 50 may have a front portion disposed in front of the opening 22.

The control panel 4 may include a knob decorative member 56 disposed around the rotary knob 50. The knob decorative member 56 may be disposed between the circumference, or perimeter, of the rotary knob 50 and the circumference, or perimeter, of the opening 22. The knob decorative member 56 may make an appearance around the rotary knob 50 look expensive and elegant. The knob decorative member 56 may have an exterior surface having the same color as the control panel body 20.

The control panel 4 may further include a window 82 disposed to surround a circumference of the rotary knob 50. The laundry treating apparatus may radiate light to the window 82. The light radiated to the window 82 may pass through the window 82, and, as such, a user may recognize various information of the laundry treating apparatus by viewing a shape or a position of the light having passed through the window 82. The window 82 may be partially exposed to the outside through a clearance between the knob decorative member 56 and the circumference of the opening 22, and the light may be radiated through the exposed portion of the window 82.

Figure 2:
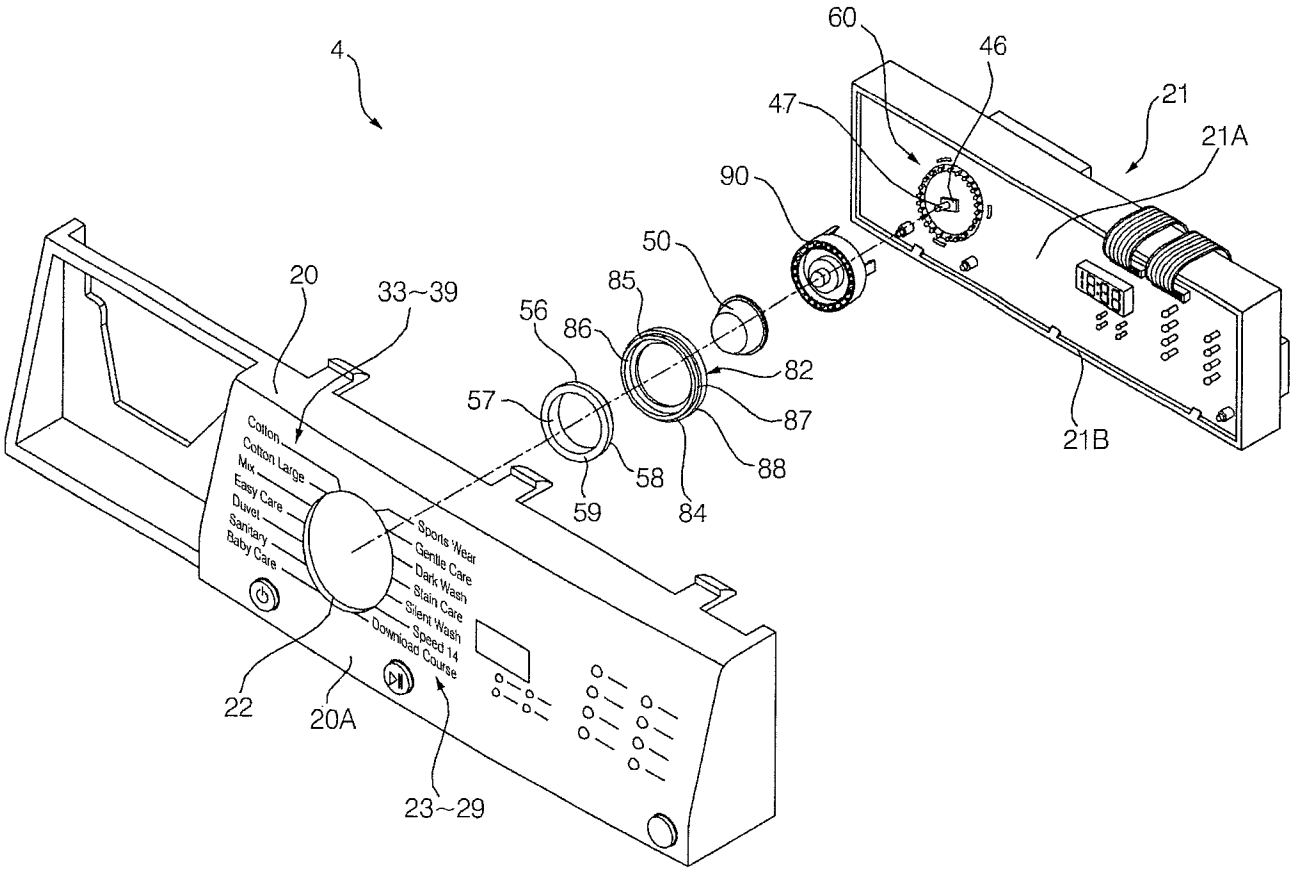
FIG. 2 is an exploded perspective view of a control panel of a laundry treating apparatus.
Figure 3:
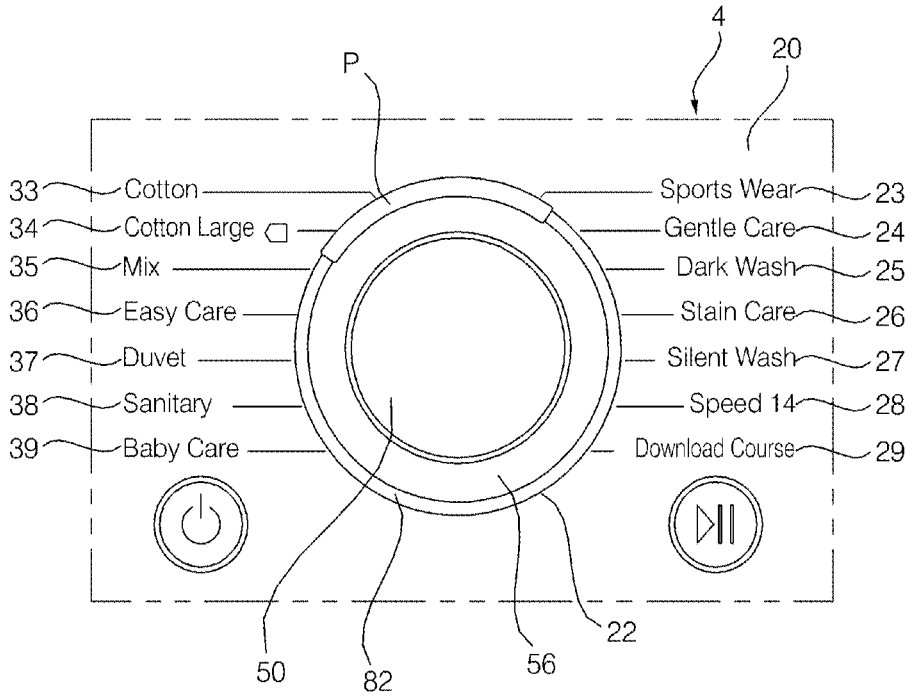
FIG. 3 is an enlarged front view of part of a control panel of a laundry treating apparatus.
Figure 4:
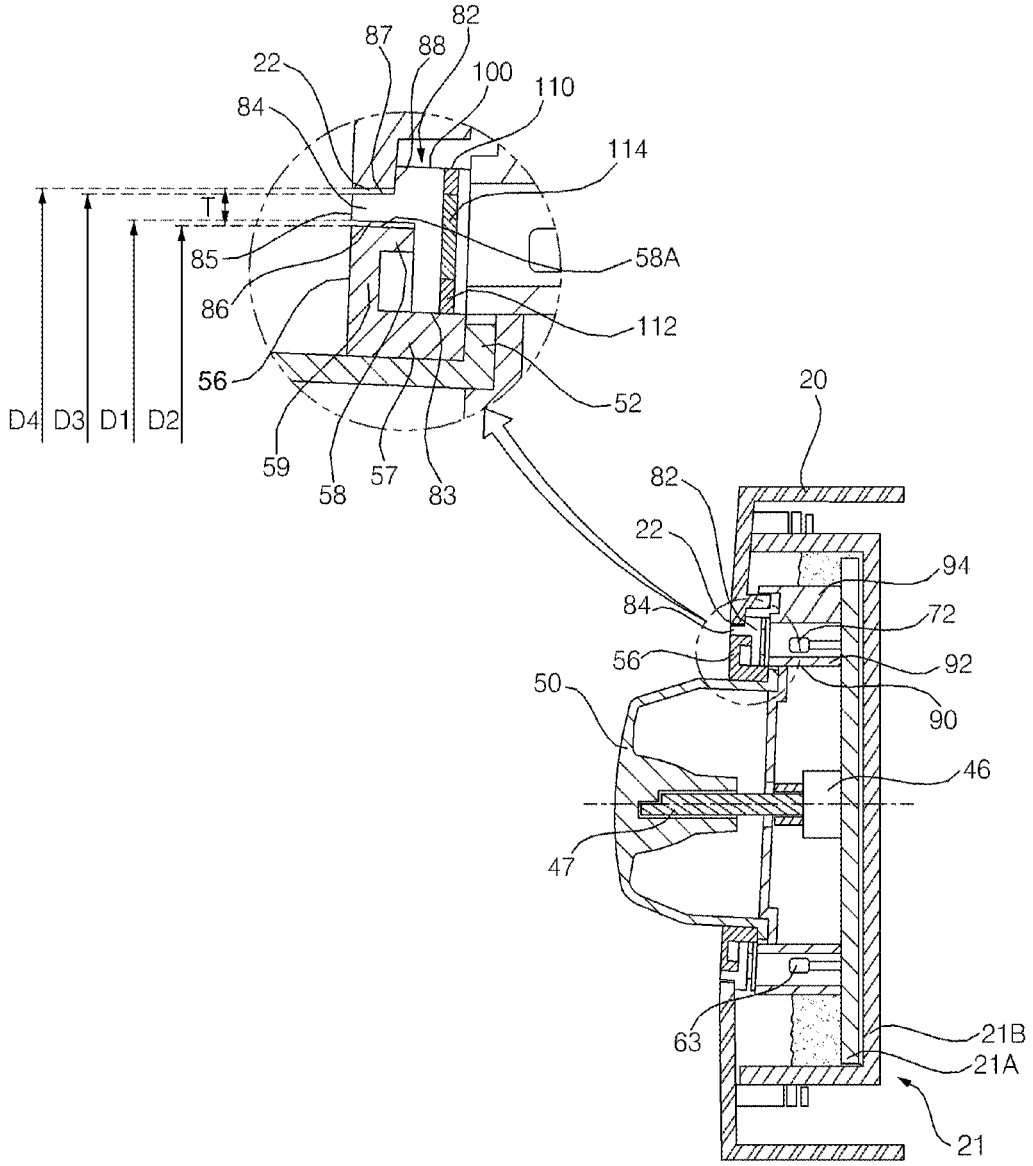
FIG. 4 is a longitudinal cross-sectional view of part of a control panel of a laundry treating apparatus.
Figure 5:
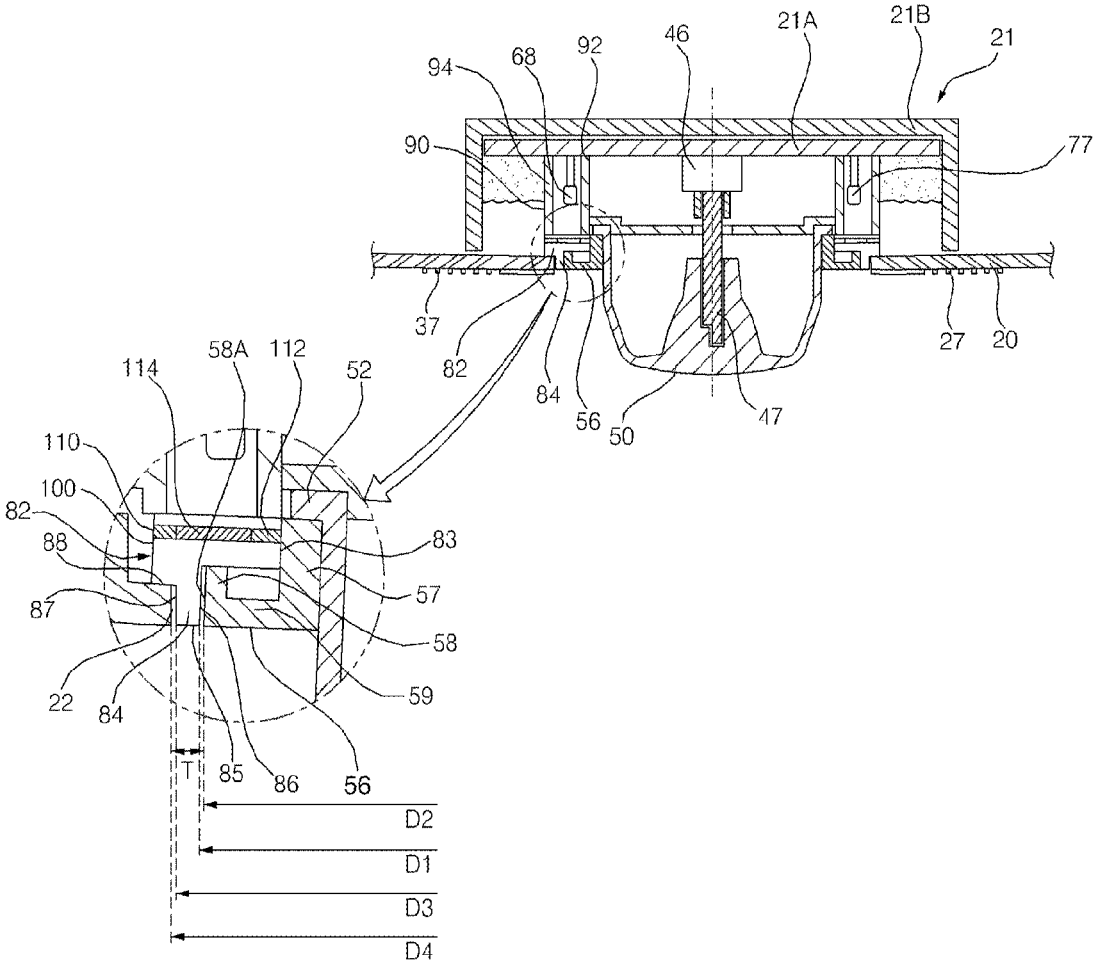
FIG. 5 is a transverse cross-sectional view of part of a control panel of a laundry treating apparatus.
Figure 6:
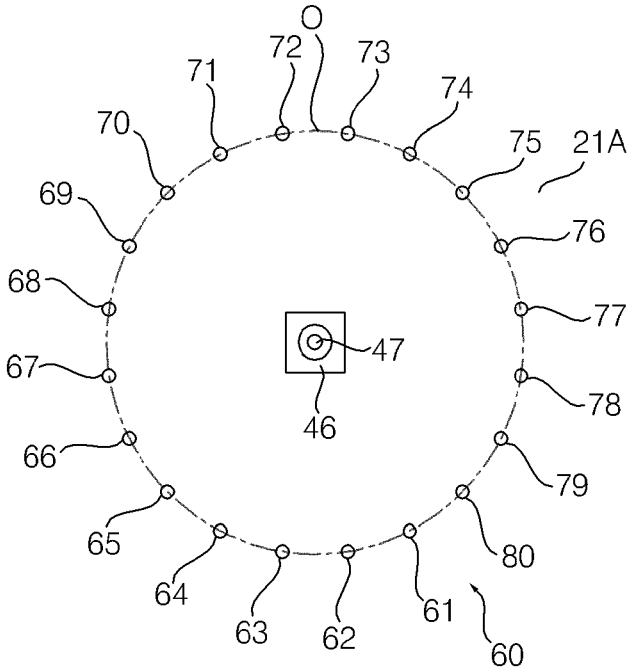
FIG. 6 is an enlarged front view of a plurality of LEDs of a laundry treating apparatus.
Figure 7:
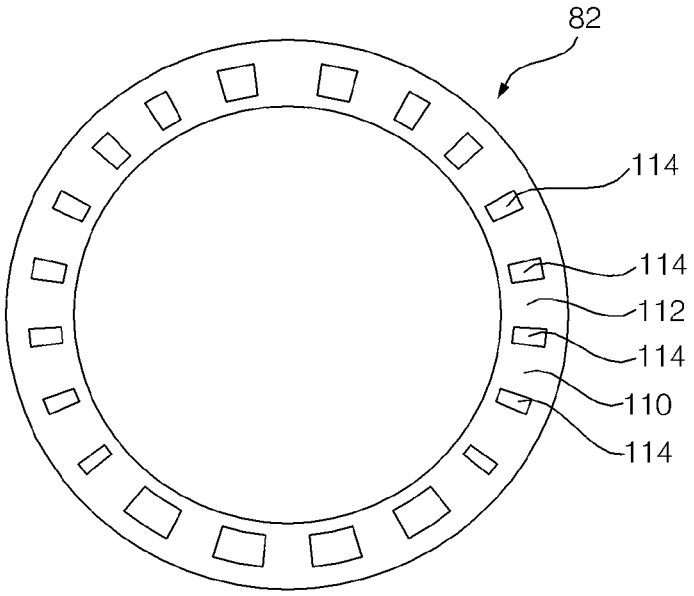
FIG. 7 is a rear view of a window of a laundry treating apparatus.

FIG. 2 illustrates an example control panel of a laundry treating apparatus. FIGS. 3-5 illustrate parts of an example control panel of a laundry treating apparatus. FIG. 6 illustrates an example plurality of LEDs of a laundry treating apparatus. FIG. 7 illustrates an example window of a laundry treating apparatus.

The laundry treating apparatus may include a printed circuit board (PCB) assembly 21 installed in the control panel body 20. The PCB assembly 21 may include a PCB 21A, and a PCB mount 21B at which the PCB 21A is installed. The PCB mount 21B may be mounted on the control panel body 20 by means of a fastening element such as a screw. The PCB assembly 21 may include a rotary switch 46. The rotary switch 46 may include a rotating central shaft 47 to which the rotary knob 50 is joined. Upon rotation of the rotating central shaft 47, the rotating central shaft 47 may rotate with the rotary knob 50. The rotary switch 46 may include a rotary encoder in which a plurality of switching circuits are provided. The rotary switch 46 may detect rotation of the rotating central shaft 47. The PCB assembly 21 may further include a switch such as a tap switch and a touch switch. The control panel 4 may include a display component for displaying information of the laundry treating apparatus.

The laundry treating apparatus includes a control panel body 20 having the opening 22, the rotary knob 50 spaced apart from a circumference of the opening 22 to manipulate the rotary switch 46, the knob decorative member 56 disposed between the rotary knob 50 and the circumference of the opening 22 and smaller than that of the opening 22, at least one light source 60, and the window 82 through which light emitted from the light source 60 passes.

The control panel body 20 may include a front panel 20A at which the opening 22 is formed. The opening 22 may be formed to be larger than the rotary knob 50 and the knob decorative member 56. The opening 22 may be formed into a circular shape.

As illustrated in FIGS. 2 and 3, the control panel body 20 may include one or more indicators 23-29 and 33-39 for displaying treatment courses which may be selected by the rotary knob 50.

The indicators 23-29 and 33-39 constitute a course display unit that represents various courses (washing programs) of the laundry treating apparatus as numerals, symbols, characters and the like. Each of the indicators 23-29 and 33-39 may be constituted by embossed or engraved lettering formed on the control panel body 20 or a coating applied to the control panel body 20. In addition, the indicators 23-29 and 33-39 may be provided on the control panel body through various technologies other than printing and coating. The indicators 23-29 and 33-39 may include at least two indicators, and the at least two indicators may be disposed around the hole 22. A user may recognize a treatment course of the laundry treating apparatus by observing the at least two indicators 23-29 and 33-39, and may select a desired course among the plurality of treatment courses by rotating the rotary knob 50.

The laundry treating apparatus may radiate light to an area near one of the plurality of indicators 23-29 and 33-39 that is selected by a user, and, as such, a user may recognize the indicator closest to the area to which the light is radiated. Each of the plurality of indicators 23-29 and 33-39 may include characters representing the corresponding course. Each of the plurality of indicators 23-29 and 33-39 may further include a line between the opening 22 and the characters. The laundry treating apparatus may radiate light to an area near one of lines associated with the plurality of indicators 23-29 and 33-39, and, as such, a user may recognize the indicator associated with the line closest to the light radiated from the laundry treating apparatus.

The indicators 23-29 and 33-39 may include left indicators 23-29 positioned at the left side of the opening 22, and right indicators 33-39 positioned at the right side of the opening 22.

The plurality of left indicators 23-29 may be positioned together at the left side of the opening 22, and may be spaced apart from one another in the vertical direction.

The plurality of right indicators 33-39 may be positioned together at the right side of the opening 22, and may be spaced apart from one another in the vertical direction.

The rotary knob 50, which serves as a handle capable of being manipulated by a user, may be connected to the rotary switch 46. The rotary knob 50 may be manipulated by a user in the state of being partially disposed in the opening 22. The rotary knob 50 may have a front portion disposed in front of the opening 22 and thus may be exposed to the outside of the laundry treating apparatus. The rotary knob 50 may have a rear portion disposed in the rear of the opening 22, that is, in the control panel body 20. When a front portion of the rotary knob 50 is gripped and rotated by a user, the rotary switch 46 may detect a rotating angle of the rotating central shaft 47 rotating with the rotary knob 50, and the laundry treating apparatus may execute the course selected by rotation of the rotary knob 50.

The rotary knob 50 may include a seating portion 52 that is formed at a rear end thereof and is seated on a light guide that will be described below.

The knob decorative member 56 may have a larger internal diameter than an external diameter of the rotary knob 50. The knob decorative member 56 may have an external diameter D2 that is equal to or smaller than a diameter D4 of the opening 22. The knob decorative member 56 may be coupled to the window 82.

The knob decorative member 56 may make an appearance around the rotary knob 50 look expensive and elegant. The knob decorative member 56 may have the same color as that of the control panel body 20. When the knob decorative member 56 and the front panel body 20 have the same color, the knob decorative member 56 and the front panel body 20 may look like an integrated panel disposed around the rotary knob 50, and the light transmission portion 84 of the window 82 may look like an annular protruding portion connected to the panel, thus improving the aesthetics.

The knob decorative member 56 may include an inner cylinder 57 facing an outer surface of the rotary knob 50, an outer cylinder 58 lager than the inner cylinder 57 and disposed in such a manner that an outer surface thereof faces an inner surface of the light transmission portion 84, and a front annular portion 59 connected between the inner cylinder 57 and the outer cylinder 58.

The inner cylinder 57 may be configured such that an outer surface thereof partially faces an inner surface 83 of the window 82.

The outer cylinder 58 may have an external diameter smaller than the diameter D4 of the opening 22. The laundry treating apparatus may have a clearance T between the knob decorative member 56 and the opening 22. The clearance T may have an annular shape. The clearance T may be defined between an outer surface of the outer cylinder 50 of the knob decorative member 56 and a circumference of the opening 22.

The front annular portion 59 may be exposed to the outside at the front surface thereof. The front surface of the front annular portion 59 may be positioned around the rotary knob 50 to improve the aesthetics of the rotary knob 50. The front surface of the front annular portion 59 may have the same color as that of the front surface of the control panel body 20. The knob decorative member 56 may have the same white color as that of the control panel body 20.

The at least one light source 60 may be one component of the PCB assembly 21. The light source 60 may be mounted on the PCB 21A. The at least one light source 60 may be constructed to create an arcuate lighting pattern P or an annular lighting pattern. The at least one light source 60 may be composed of a plurality of LEDs 60. For convenience in the following description, the at least one light source 60 and the plurality of LEDs 60 are denoted by the same numeral.

The plurality of LEDs 60 may be arranged on the PCB 21A in a circular shape. The number of the plurality of LEDs 60 may be larger than that of the indicators 23-29 and 33-39. The plurality of LEDs 60 may be disposed around the rotary switch 46 of the PCB 21A. The plurality of LEDs 60 may be sequentially disposed along a virtual circle O around the rotary switch 46. The plurality of LEDs 60 may be disposed to surround the rotary switch 46. The plurality of LEDs 60 may be spaced apart from one another along the virtual circle O. The plurality of LEDs 60 may be positioned spaced apart from one another along the virtual circle O at substantially regular intervals. The plurality of LEDs 60 may be spaced apart from one another along the virtual circle O in a clockwise or counterclockwise direction.

The plurality of LEDs 60 may include course LEDs 65-71 and 74-80, and non-course LEDs 61-64, 72, and 73. The course LEDs 65-71 and 74-80 may be one or more LEDs that light up while the laundry treating apparatus displays a treatment course. The non-course LEDs 61-64, 72, and 73 may be one or more LEDs that do not light up while the laundry treating apparatus displays a treatment course.

Similarly to the indicators 23-29 and 33-39, the one or more course LEDs 65-71 and 74-80 may also include a plurality of LEDs. The number of the course LEDs 65-71 and 74-80 may be the same as that of the indicators 23-29 and 33-39. Each of the course LEDs 65-71 and 74-80 may be assigned one indicator.

Upon input of a power supply command, the course LEDs 65-71 and 74-80 may be turned on or off in accordance with preset control. Upon input of a power supply command, the first LEDs 65-71 and 74-80 may be turned on or off so as to create a lighting pattern representing power input. Plural LEDs among the course LEDs 65-71 and 74-80 may be selectively turned on during a period for which the laundry treating apparatus displays a treatment course.

The number of the non-course LEDs 61-64, 72, and 73 provided at the PCB 21A may be one or more, preferably two or more. The number of the non-course LEDs 61-64, 72, and 73 may be less than the number of the indicators 23-29 and 33-39.

Upon input of a power supply command, the non-course LEDs 61-64, 72, and 73 may be turned on or off in accordance with preset control. Upon input of a power supply command, the non-course LEDs 61-64, 72, and 73 may be turned on or off so as to create the lighting pattern representing power input.

When only one of the plurality of LEDs 60 is turned on and the other LEDs are turned off, a small spot lighting pattern may be created at a predetermined position of a light transmission portion 84. When at least one of the plurality of LEDs 60 is turned off and the other LEDs are turned on, an arcuate lighting pattern may be created in a partial area of the light transmission portion 84. When all of the plurality of LEDs 60 are turned on, an annular lighting pattern may be created throughout the light transmission portion 84.

The plurality of LEDs 60 may be controlled in such a manner as to create the spot lighting pattern and then the arcuate lighting pattern. The plurality of LEDs 60 may be controlled in such a manner that the arcuate lighting pattern is rotated along the light transmission portion 84 clockwise or counterclockwise. The plurality of LEDs 60 may be controlled in such a manner as to create the arcuate lighting pattern and then the annular lighting pattern. The plurality of LEDs 60 may be controlled in such a manner that the arcuate lighting pattern is gradually decreased in size and then is changed into the spot lighting pattern. The plurality of LEDs 60 may create a wider variety of lighting patterns by combination of the spot lighting pattern, the arcuate lighting pattern and the annular lighting pattern.

The window 82 may include the light transmission portion 84 disposed in the clearance T. The light transmission portion 84 may protrude from the window 82. The light transmission portion 84 may be disposed to surround an outer surface 58A of the knob decorative member 56. The light transmission portion 84 may have an annular shape. The light transmission portion 84 may include an annular exposed surface 85 that is exposed to the outside. The annular exposed surface 85 may be a front surface. The annular exposed surface 85 may be a continuous shape extending clockwise or counterclockwise without disconnection. The light transmission portion 84 may be configured such that an inner surface 86 of the light transmission portion 84 faces an outer surface 58A of the knob decorative member 56 and an outer surface 87 of the light transmission portion 84 faces an inner surface of the opening 22. The light transmission portion 84 may have an internal diameter D1 that is equal to or larger than the external diameter D2 of the knob decorative member 56. The light transmission portion 84 may have an external diameter D3 that is equal to or smaller than the diameter D4 of the opening.

The window 82 may include a stepped portion 88 contacting the control panel body 20. The stepped portion 88 may face a rear surface of the front panel of the control panel body 20 in an anteroposterior direction.

The window 82 may be fitted over the knob decorative member 56. One of the knob decorative member 56 and the window 82 may be provided with a protrusion and the other of the knob decorative member 56 and the window 82 may be provided with a plurality of ribs between which the protrusion is fitted. The protrusion may be fitted between the plurality of ribs in an anteroposterior direction. By fitting the protrusion in the plurality of ribs, the knob decorative member may be coupled to the window. The knob decorative member 56 may be provided with a plate-shaped protrusion protruding toward the window 82, and the window 82 may include a plurality of fitting ribs protruding toward the knob decorative member provided at a surface thereof facing a rear surface of the knob decorative member.

The window 82 may include a window body 100 from which the light transmission portion 84 protrudes, and a diffusion portion 110 provided at a rear surface of the window body 100.

The window body 100 may include the light transmission portion 84 formed at a front surface thereof which protrudes forward. The rear surface of the window body 100 may be a flat surface. The window body 100 may be transparent. The window body 100 may be made of an acrylic material.

The diffusion portion 110 may include a first region 112 having a first light transmittance, and a second region 114 having a second light transmittance that is higher than the first light transmittance. The diffusion portion 110 may be a diffusion sheet provided at the rear surface of the window body 100. The diffusion portion 110 may be composed of at least one diffusion layer formed by printing, coating and the like. The diffusion layer 110 may be composed of one diffusion layer, or may be composed of a plurality of diffusion layers laminated with each other.

The second region 114 of the diffusion portion 110 may be positioned in front of the LEDs, and the remaining region of the rear surface of the window 82 excluding the second region 114 may be the first region 112.

The first region 112 may be disposed on the rear surface of the window body 100 to form an annular shape. The first region 112 may serve as a shield portion for blocking light emitted from the LEDs.

The second region 114 may be configured to be positioned between the LEDs and the light transmission portion 84 and to face the LEDs. The second region 114 may serve as a light transmission portion through which light emitted from the LEDs passes. The second region 114 may be positioned to at least partially face the light transmission portion 84. The second region 114 may include a plurality of second regions provided in the diffusion portion 110. The plurality of second regions 114 may be spaced apart from each other in the circumferential direction of the window body 100. The plurality of second regions 114 may have the same number as that of the LEDs, and the plurality of second regions 114 may correspond to the LEDs, respectively. Some of the plurality of second regions 114 may be second course regions facing the course LEDs 65-71 and 74-80, and the others of the plurality of second regions 114 may be second non-course regions facing the non-course LEDs 61-64, 72, and 73.

The laundry treating apparatus may further include a light guide 90 for protecting the plurality of LEDs 60 and guiding light emitted to the window 82 from the LEDs. The light guide 90 may mounted on the PCB 21A by means of a holding element such as a hook.

The light guide 90 may include an inner wall 92 and an outer wall 94 with an annular space defined therebetween. The plurality of LEDs 60 may be circumferentially disposed in the annular space to be spaced apart from one another. The light guide 90 may further include at least one rib that divides the annular space into a plurality of cells. The rib may be formed to be connected between the inner wall 92 and the outer wall 94. The light guide 90 may include a plurality of cells defined by a plurality of ribs. Each of the plurality of LEDs 60 may be disposed in one of the plurality of cells. Light emitted from the LEDs may pass through the cells and may be radiated to the window 82.

Hereinafter, an operation of the laundry treating apparatus will be described.

The power supply command may be input to the laundry treating apparatus by manipulating a power key provided at the control panel 4. The plurality of LEDs 60 may be controlled to create the arcuate lighting pattern or the annular lighting pattern.

Upon input of a power supply command, at least two clockwise or counterclockwise consecutive LEDs of the plurality of LEDs 60 may be turned on and all of the other LEDs may be turned off. At this time, light emitted from the at least two lighting LEDs may be radiated only to a part of the rear surface of the window 82. The light radiated to the window 82 from the at least two LEDs may pass through the second region 114 occupying a part of the diffusion portion 110 and then may be radiated to a partial region of the light transmission portion 84 of the window 82.

As illustrated in FIG. 3, a bright lighting pattern may be created only at a partial region of the light transmission portion 84 of the window 82 which is positioned in front of the at least two lighting LEDs, and thus an arcuate lighting pattern P may be created at the light transmission portion 84 of the window 82. At this time, a user may recognize a continuous arcuate lighting pattern P created between the control panel body 20 and the knob decorative member 56. The arcuate lighting pattern enables a user to easily recognize a position of the rotary knob 50, a manipulation method, a usage of the apparatus and a manipulation time.

Upon input of a power supply command, all of the plurality of LEDs 60 may be sequentially turned on at time intervals or may be concurrently turned on. At this time, light emitted from the plurality of LEDs 60 may be radiated to the entire rear surface of the window 82. The light radiated to the entire rear surface of the window 82 from the plurality of LEDs 60 may pass through the second region 114 of the diffusion portion 110 and then may be diffused throughout the light transmission portion 84 of the window 82.

A bright lighting pattern may be created in the entire area of the light transmission portion 84 of the window 82, and thus an annular lighting pattern may be created at the light transmission portion 84 of the window 82. Consequently, a user may recognize one continuous annular lighting pattern created between the control panel body 20 and the knob decorative member 56, and may easily recognize a position of the rotary knob 50 and a manipulation time through the annular lighting pattern.

Upon selection of a course by a user, the laundry treating apparatus may create various lighting patterns having different sizes and shapes such as the arcuate lighting pattern and the annular lighting pattern.

When the rotary knob 50 is gripped and rotated by a user, the laundry treating apparatus may create a small lighting pattern that varies in position by rotation of the rotary knob 50. When the rotary knob 50 is gripped and rotated by a user, one LED of the plurality of LEDs 60 may be selectively turned on and all of the other LEDs may be turned off.

As the rotary knob 50 is further rotated by a user, the lit LED of the plurality of LEDs 60 may be sequentially replaced with the adjacent LED in a rotation direction of the rotary knob 50, and thus a small lighting pattern, that sequentially varies in position along the annular light transmission portion 84 of the window 82, may be created on the light transmission portion 84.

When the rotary knob 50 is rotated, the lighting pattern created on the light transmission portion 84 of the window 82 may be positioned between the control panel body 20 and the knob decorative member 56 and may be positioned closest to the indicators.

Upon selection of a course by rotation of the rotary knob 50, since the lighting pattern is positioned closest to the indicators, a user may more accurately recognize the selected course than when the indicators are far away from the lighting pattern.

As described above, the subject matter described in this application may prevent contaminants from infiltrating between the knob decorative member and the circumference of the opening by virtue of provision of the light transmission portion of the window, and may represent the arcuate or annular lighting pattern between the control panel body and the knob decorative member in a continuous manner.

Furthermore, since the lighting pattern may be created at a position closest to the indicators formed at the control panel body, it is possible to eliminate inconvenience that may occur when the indicators are far away from the lighting pattern.

In addition, since the lighting pattern is brightly represented around the knob decorative member, the aesthetics of the knob decorative member may be improved, thus making the apparatus look expensive and elegant.

Furthermore, since the light transmission portion provides an integral appearance as viewed from the outside, the aesthetics of the apparatus may be improved and cleaning of the light transmission portion may be facilitated.

A laundry treating apparatus as described in this application may be applied to any of a top loading type laundry treating apparatus which includes a laundry port formed at the top of a cabinet which allows laundry to be put into or taken out therethrough, and a front loading type laundry treating apparatus which includes a laundry port formed at a front or side surface of a cabinet. In a subsequent description, a front loading type laundry treating apparatus will be described by way of example.

The laundry treating apparatus should be considered to include all apparatuses for treating laundry. More specifically, the laundry treating apparatus may include a washing machine intended to remove contaminants from laundry using washing water, a dryer intended to remove moisture from laundry so as to dehydrate the laundry, and a combination washer/dryer having both washing and drying functions.

The dryer may include a drum dryer which is constructed to supply hot air into a rotatable drum so as to dry laundry, and a cabinet type dryer (refresher) which is constructed to supply hot air into a drying space accommodating laundry.

What is claimed is:

1. A laundry treating apparatus comprising:

a control panel body that is provided with a circular opening in the control panel body;

at least one light source;

a rotary knob that is configured to manipulate a rotary switch and that has an outer circumferential surface that is spaced apart from the circular opening;

a knob decorative member that is located between the rotary knob and the circular opening and that defines a clearance between the rotary knob and the circular opening by having a diameter that is smaller than the diameter of the circular opening; and a window that includes a light transmission portion through which light emitted from the at least one light source passes, the light transmission portion of the window surrounding the knob decorative member, wherein the knob decorative member comprises:

an inner cylinder having an outer circumferential surface that faces an inner circumferential surface of the window;

an outer cylinder that has a larger diameter than a diameter of the inner cylinder and that has an outer circumferential surface facing an inner circumferential surface of the light transmission portion; and a front annular portion connected between the inner cylinder and the outer cylinder.

2. The laundry treating apparatus according to claim 1, wherein the light transmission portion has an annular exposed surface that is exposed to an outside of the laundry treating apparatus.

3. The laundry treating apparatus according to claim 2, wherein the annular exposed surface is continuous across the light transmission portion of the window.

4. The laundry treating apparatus according to claim 1, wherein the clearance and the light transmission portion both have an annular shape.

5. The laundry treating apparatus according to claim 1, wherein the light transmission portion has an inner circumferential surface that faces the outer circumferential surface of the inner cylinder of the knob decorative member, and an outer circumferential surface that faces a perimeter of the circular opening.

6. The laundry treating apparatus according to claim 1, wherein the light transmission portion has an internal diameter that is larger than an external diameter of the inner cylinder of the knob decorative member, and an external diameter that is smaller than a diameter of the circular opening.

7. The laundry treating apparatus according to claim 1, wherein the window has a stepped portion that contacts the control panel body.

8. The laundry treating apparatus according to claim 7, wherein a front of the stepped portion and a back of the stepped portion both contact the control panel body.

9. The laundry treating apparatus according to claim 1, wherein the knob decorative member and the control body have a same color.

10. The laundry treating apparatus according to claim 1, wherein the window comprises:

a window body that protrudes from the light transmission portion; and a diffusion portion located at a rear surface of the window body, the diffusion portion including a first region that has a first light transmittance and a second region that has a second light transmittance that is greater than the first light transmittance, wherein the second region at least partially faces the light transmission portion.

11. The laundry treating apparatus according to claim 10, wherein the diffusion portion comprises a diffusion sheet that is located at a rear surface of the window body and that is printed on or coats the diffusion portion.

12. The laundry treating apparatus according to claim 10, wherein the first region of the diffusion portion is configured to block light from the at least one light source.

13. The laundry treating apparatus according to claim 1, wherein the knob decorative member is coupled to the window.

14. The laundry treating apparatus according to claim 1, wherein the light transmission portion of the window surrounding the rotary knob is located in the clearance between the rotary knob and the control panel body.

15. The laundry treating apparatus according to claim 1, wherein a thickness of the inner cylinder of the knob decorative member is greater than a thickness of the outer cylinder of the knob decorative member, the thickness of the inner cylinder and the thickness of the outer cylinder being defined along an axis that is parallel to an axis of rotation of the rotary knob.

16. The laundry treating apparatus according to claim 1, wherein a thickness of the annular portion is less than a thickness of the inner cylinder of the knob decorative member and thickness of the outer cylinder of the knob decorative member, the thickness of the annular portion being defined along an axis that is parallel to an axis of rotation of the rotary knob.

* * * * *